US005298468A

United States Patent [19]

Pyzik

[11] Patent Number: 5,298,468

[45] Date of Patent: Mar. 29, 1994

[54] BORON CARBIDE-ALUMINUM CERMETS HAVING MICROSTRUCTURES TAILORED BY A POST-DENSIFICATION HEAT TREATMENT

[75] Inventor: Aleksander J. Pyzik, Midland, Mich.

[73] Assignee: The Dow Chemical Company, Midland, Mich.

[21] Appl. No.: 960,612

[22] Filed: Oct. 13, 1992

Related U.S. Application Data

[63] Continuation-in-part of Ser. No. 789,380, Nov. 6, 1991, abandoned, which is a continuation of Ser. No. 609,322, Nov. 2, 1990, abandoned.

[51] Int. Cl.[5] ..... C04B 35/56

[52] U.S. Cl. ..... 501/87; 501/93; 501/96; 419/15; 419/29; 419/45; 419/54

[58] Field of Search ..... 501/87, 93, 96; 419/14, 419/15, 16, 29, 45, 54; 75/238, 241

[56] References Cited

U.S. PATENT DOCUMENTS

| | | | |
|---|---|---|---|
| 4,428,906 | 1/1984 | Rozmus . | |
| 4,605,440 | 8/1986 | Halverson et al. . | |
| 4,656,002 | 4/1987 | Lizenby et al. . | |
| 4,702,770 | 10/1987 | Pyzik et al. . | |
| 4,718,941 | 1/1988 | Halverson et al. . | |
| 4,744,943 | 5/1988 | Timm . | |
| 4,861,778 | 10/1990 | Pyzik et al. . | |
| 5,039,633 | 8/1991 | Pyzik et al. | 419/16 X |

*Primary Examiner*—Karl Group

[57] ABSTRACT

Densified boron carbide-aluminum, ceramic-metal composites that are substantially free of $AlB_{12}$, $AlB_{12}C_2$ and $Al_4C_3$ result from a two stage process. Admixtures of boron carbide are densified under pressure in stage one, In stage two, the densified admixture is heat treated. In both stages, the temperature is less than 800° C. If the temperatures do not exceed 600° C., the resultant densified cermet has only three phases: a) boron carbide; b) $Al_4BC$; and c) aluminum.

6 Claims, No Drawings

BORON CARBIDE-ALUMINUM CERMETS HAVING MICROSTRUCTURES TAILORED BY A POST-DENSIFICATION HEAT TREATMENT

STATEMENT AS TO RIGHTS TO INVENTION MADE UNDER FEDERALLY-SPONSORED RESEARCH AND DEVELOPMENT

The United States Government has rights to this invention pursuant to Contract No. DAAL-03-88-C0030 between The Defense Advanced Research Project Agency and The Dow Chemical Company.

CROSS-REFERENCES TO RELATED APPLICATIONS

This application is a continuation-in-part of application Ser. No. 07/789,380, filed Nov. 6, 1991, now abandoned, which is a continuation of application Ser. No. 07/609,322, filed Nov. 2, 1990, now abandoned.

BACKGROUND OF THE INVENTION

The present invention relates generally to preparing ceramic-metal composites or cermets from boron carbide and aluminum, an aluminum alloy, or an aluminum compound that is reduced to aluminum or an aluminum alloy during processing. The present invention relates more particularly to the preparation of such composites at temperatures below 800° C. The present invention also relates to the resultant cermets.

DESCRIPTION OF RELATED ART

Cermets usually have a microstructure characterized by a ceramic phase content of greater than 50 volume percent. Cermets have physical characteristics and properties that differ from those possessed by either the ceramic portion or the metal portion alone. For example, cermets typically have greater toughness than pure, or monolithic, ceramics and greater hardness than the metal.

U.S. Pat. No. 4,605,440 discloses boron carbide-aluminum and boron carbide-reactive metal cermets and a process for preparing such cermets. The process includes three major steps: (1) consolidation or preparation of the starting materials; (2) wetting the starting materials; and (3) reacting or heat treating the starting materials to produce the desired compositions. Wetting or processing temperatures for aluminum are within a range of about 1050° C. to about 1250° C. Reactions occur at temperatures within a range of about 800° C. to about 1400° C. At 800° C. the resultant cermet contains boron carbide, aluminum, a phase denominated as "X", $AlB_2$, $\alpha$-$AlB_{12}$, $AlB_{12}C_2$ and $Al_4C_3$. $AlB_{12}C_2$ and $Al_4C_3$ are believed to adversely affect the properties of the resultant cermets. Phase "X" is believed to be $Al_4BC$.

U.S. Pat. No. 4,702,770 discloses a process whereby chemical reaction kinetics between boron carbide and aluminum are reduced by sintering a boron carbide preform or porous green body at a temperature above 2100° C. before it is infiltrated with aluminum. Infiltration occurs at a temperature above 1150° C. The process does not eliminate formation of all ceramic phases that adversely affect cermet properties. In addition, the temperature used for infiltration may lead to composition changes when the metal is an aluminum alloy.

U.S. Pat. No. 4,718,941 discloses a process wherein boron carbide or another ceramic starting material is chemically pre-treated prior to consolidation into a ceramic precursor or sponge. Infiltration is carried out under the wetting and reaction conditions disclosed in U.S. Pat. No. 4,605,440.

U.S. Pat. No. 4,961,778 discloses a process for preparing dense cermets that have a final composition substantially similar to that of the ceramic and metal powder mixtures from which they are formed. In addition, the cermets have a grain size similar to that of the powder mixtures. The process begins by forming a substantially homogeneous mixture of ceramic and metal materials. The mixture, typically formed into greenwares is then heated to a first temperature that is below that at which the metal begins to flow. The heated mixture is then pressed under conditions sufficient to induce a short term temperature increase to a temperature above that at which the metal begins to flow. The conditions produce a cermet that is near 100 percent of theoretical density with respect to the homogeneous mixture. The temperature, both in terms of value and duration, remains below that at which significant undesired reaction occurs between the mixture components.

SUMMARY OF THE INVENTION

One aspect of the present invention is a method for preparing a densified boron carbide-aluminum) ceramic-metal composite comprising: a) consolidating a powdered admixture of boron carbide and a metal selected from the group consisting of aluminum and aluminum alloys at a pressure of from about 34 to about 827 MPa and a temperature of from about 550° C. to less than 800° C. to produce a densified composite having a density of greater than about 98 percent of theoretical density based upon the powdered admixture; and b) subjecting the densified composite to a heat treatment at a temperature of from about 450° C. to less than 800° C. for a time of from about 1 to about 50 hours to produce a densified boron carbide-aluminum, ceramic-metal composite that is substantially free of $AlB_{12}$, $AlB_{12}C_2$ and $Al_4C_3$.

A second, related aspect of the present invention is a dense boron carbide-aluminum, ceramic-metal composite consisting essentially of three phases: a) boron carbide; b) $Al_4BC$; and c) aluminum, the aluminum being homogeneously distributed in the composite.

DETAILED DESCRIPTION OF THE INVENTION

Aluminum is a useful metal for developing boron carbide-aluminum cermets because it reacts with boron carbide. It is a terrestrially stable metal with a low specific gravity. It is also ductile, nontoxic, relatively inexpensive, easy to obtain, and commercially available in corrosion-resistant forms.

Aluminum alloys and aluminum compounds that are reduced to aluminum or an aluminum alloy during processing may be used in place of aluminum metal. As used herein, "aluminum alloys" include metal alloys having an aluminum content of at least 50 percent by volume, based upon alloy volume. Metals conventionally alloyed with aluminum include magnesium, zinc, copper, manganese, silicon, and iron.

"Theoretical density", as used herein, is a calculated value based upon weight fraction and density of the starting components. "Substantially fully dense". as used herein, means either a density of 99 percent or more of theoretical density or a porosity of less than about 1 volume percent.

Boron carbide and aluminum or an aluminum alloy are used as starting materials. The starting materials, desirably in particulate or powder form, are suitably converted to a powdered admixture by conventional procedures. Dry mixing may be used and ball milling yields acceptable results. Attritor milling, which uses balls of hard material to promote mixing, provides particularly satisfactory results.

Attritor mixing is desirably accomplished with the aid of a liquid such as methanol. The attrited mixture is preferably dried before further processing. Particularly satisfactory results are obtained by screening or classifying the attrited and dried mixture to remove unwanted agglomerates and fines.

The powdered admixture is desirably converted to a preform or porous ceramic greenware using conventional procedures. Cold isostatic pressing the admixture at a pressure of 30,000 psi (207 MPa) to 45,000 psi (310 MPa) is especially effective. A pressure of less than 207 MPa does not yield a sufficiently high green density. A pressure in excess of 310 MPa offers no appreciable increase in green density over that attained at 310 MPa.

The canned greenware is subjected to pressure assisted densification at an elevated temperature using one of several techniques known to those skilled in the art. The techniques include hot pressing, hot isostatic pressing (HIP'ing) and rapid omnidirectional compaction (ROC). Although any of these techniques may be used with varying degrees of success, particularly suitable results are obtained by the ROC technique. The ROC technique uses mechanically induced pressure, such as that generated with a forging press, as a means of densifying greenware.

The greenware or preform is desirably "canned" or placed in an impervious container prior to densification. Canning is preferred in the ROC process in order to preclude molten glass used as a pressure transmission medium from contacting the greenware. The, container may be fabricated from any material that does not react with the greenware during subsequent processing. The container is desirably fabricated from stainless steel or aluminum. Aluminum containers are preferred because they deform readily at processing temperatures.

U.S. Pat. No. 4,744,943 discloses one variation of the ROC process. Greenware, whether canned or not, is placed in a fluid die assembly that is then heated to a desired temperature. The heated fluid die assembly and its contents are then subjected to an applied pressure for a time of less than one hour. The time is suitably less than about 30 minutes, desirably less than about one minute, and preferably less than about 30 seconds. A time of from about 10 to about 30 seconds is quite effective. The relevant teachings of U.S. Pat. No. 4,744,943 are incorporated herein by reference.

The fluid die assembly and the canned greenware contained therein are desirably heated to a temperature of from about 550° C. to less than 800° C. before pressure is applied. Temperatures less than about 550° C. to not yield sufficiently high densities. Temperatures of 800° C. and higher lead to formation of undesirable reaction products such as $Al_4C_3$. The temperature is preferably from about 550° C. to about 700° C., more preferably from about 600° C. to about 650° C.

The heated fluid die assembly and its contents are subjected to a pressure of from about 5,000 psi (34 MPa) to about 120,000 psi (827 MPa) for a period of time sufficient to convert the greenware to a densified composite with a density of at least 98 percent of theoretical density. Hot pressing pressures, typically near 34 MPa, necessarily must be applied for a longer time than pressures of from 10,000 psi (69 MPa) to 827 MPa and higher that are typically used in ROC processing. The pressure is desirably from about 87,000 psi (600 MPa) to about 827 MPa, preferably from about 109,000 psi (752 MPa) to about 827 MPa.

The densified composite is recovered from the fluid die assembly using conventional procedures. The procedures taught in U.S. Pat. No. 4,744,943, previously incorporated by reference, are satisfactory.

In order to produce cermets having a high degree of fracture toughness and hardness, it is necessary to tailor the cermet microstructure by a post-densification heat treatment. The heat treatment includes a temperature of from about 450° C. to less than 800° C. and a time at temperature of from about 1 to about 50 hours. The temperature is desirably from about 500° C. to less than 800° C., preferably from about 600° C. to about 700° C. The time at temperature is desirably from about 1 to about 30 hours, preferably from about 10 to about 20 hours. Time and temperature are inversely proportional. In other words, a short time at a temperature near 800° C. yields results equivalent to those obtained with a long time at a temperature near 450° C.

The post-densification heat treatment promotes formation of, depending upon the temperature and, to some extent the time at temperature, $Al_4BC$ and $AlB_2$. If the temperature is maintained below about 600° C., the resultant cermet has only three phases: boron carbide; $Al_4BC$; and, homogeneously distributed throughout the cermet, aluminum. As the temperature increases above 600° C., small amounts of $AlB_2$ begin to form. The amount increases as the temperature approaches 800° C.

The post-densification heat treatment does not promote formation of $AlB_{12}$, $AlB_{12}C_2$ and $Al_4C_3$. As such, the resultant cermet is substantially free of such compounds. The cermet desirably has a fracture toughness of 7 MPa·m½ or higher, preferably 8 to 9 MPa·m½. The cermet also desirably has a flexure strength in excess of 320 MPa, preferably from 320 MPa to about 450 MPa.

In order to prepare cermets that are substantially free of $AlB_{12}$, $AlB_{12}C_2$ and $Al_4C_3$, the starting materials must have a relatively large amount of metal relative to the amount of ceramic. An aluminum or aluminum alloy content of from about 20 to about 80, desirably from about 30 to about 80, and preferably from about 50 to about 80 percent by volume, based upon volume of the densified composite provides satisfactory results. The boron carbide content is conversely from about 80 to about 20, desirably from about 80 to about 30, and preferably from about 50 to about 20, percent by volume, based upon volume of the densified composite. Both percentages total 100 percent. The post-densification heat treatment reduces the amount of aluminum or aluminum alloy through formation of $Al_4BC$ and $AlB_2$. The reduced amount is from about 2 to about 40, desirably from about 2 to about 12 percent by volume, based upon cermet volume.

The resultant cermets have a number of potential applications. The applications include, but are not limited to, lightweight structures, cutting tools, spent nuclear fuel containers, hot and cool parts of turbine engines, impact resistant structures, abrasive and wear resistant materials, semiconducting devices, and structures requiring increased thermal shock resistance and a high degree of chemical stability.

The following examples illustrates but do not limit, the invention. All parts, proportions and percentages are by weight and all temperatures are given in degrees Centigrade unless otherwise stated.

EXAMPLE 1

The boron carbide powder used in this example has a 21.27% total carbon content, 0.4% free carbon, 1.27% oxygen and a surface area of 6.8 $m^2/g$. The major impurities are 161 ppm Ca, 142 ppm Cr, 268 ppm Fe and 331 ppm Ni. The aluminum powder (ALCAN 105) produced by Alcan-Toyo America, Inc., contains 0.8% $Al_2O_3$, 0.18% Fe and 0.12% Si and has a surface area of 0.5$m^2/g$.

Boron carbide and aluminum powders in a volumetric ratio of boron carbide to aluminum of 70:30 are dry mixed in a rotary blender, placed in a stainless steel die and then cold pressed into 75 mm diameter discs using uniaxial compaction to apply a pressure of 30,000 psi (207 MPa). No lubricants or binders are used. The discs are placed into aluminum cans and sealed under vacuum at 550°.

Each sealed cans is placed into a glass pocket fluid die and preheated in a furnace to 700° and held at that temperature for 15 minutes in a nitrogen atmosphere. Each heated fluid die is removed from the furnace and isostatically pressed at 120,000 psi (827 MPa) for 10 seconds. The pressing procedure is described in more detail in U.S. Pat. Nos. 4,744,943; 4,428,906; and 4,656,002. The relevant teachings of these patents are incorporated herein by reference. The fluid die is then cooled in air and the discs are recovered from the cans. The discs machined to remove excess surface metal.

The discs are heat treated in a mullite tube furnace under flowing argon. The heating time from room temperature to the heat treatment temperature is one hour. The discs are maintained at the heat treatment temperature for a period of 20 hours at one of two temperatures. The heat treatment temperatures are 700° and 800°.

The discs are subjected to analysis. Crystalline phases are identified by x-ray diffraction with a Phillips diffractometer using CuKα radiation and a scan rate of 2° per minute. The chemistry of all phases is determined from electron probe analysis of polished cross-sections using a CAMECA CAMEBAX electron probe. The accuracy in the determination of elemental composition is better than 3% of the amount present. The disc heat treated at 700° contains 61% $B_4C$, 28% $AlB_2$, 3.5% $Al_4BC$ and 7.5% free aluminum. The analysis does not reveal the presence of $Al_4C_3$, $AlB_{12}$ or $AlB_{12}C_2$. The ratio of $AlB_2$ to $Al_4BC$ is 8:1. The disc heat treated at 800° contains 58% $B_4C$, 13% $AlB_2$, 18% $Al_4BC$, 9% free aluminum and a combined total of about 2% of $Al_4C_3$, $AlB_{12}$ and $AlB_{12}C_2$. The ratio of $AlB_2$ to $Al_4BC$ is 0.7:1.

EXAMPLE 2

The same boron carbide and aluminum powders as in Example 1 are dry mixed and cold pressed at a pressure of 35,000 psi (241 MPa) into 24 mm diameter pellets. The pellets are heat treated under flowing argon, as in Example 1, for a period of one hour and then cooled to room temperature at about 10°/minute. The heat treatment times range from 400° to 1200°. Crystalline phase identification and phase chemistry are determined as in Example 1.

The area of the aluminum melting endotherm in the high temperature DSC scan is used as a measure of the reactivity between $B_4C$ and Al at temperatures between 550° C. and 120° C. The data are collected using a Perkin-Elmer DTA 1700 interfaced to a computer. The purge gas is ultra high purity argon flowing at about 40 cc/min. The samples are heated in alumina crucibles at about 20°/min. High purity aluminum (99.999%) is used as a standard. The percent aluminum metal is given by $A/B \times 100$, where A is the peak area in cal/g of the Al melt endotherm in the sample and B is the same for the Al standard. Precision and accuracy are about 2 percent.

The results show that the reaction between boron carbide and aluminum starts at about 450° with the formation of $Al_4BC$, but the reaction rate is slow below 600°. In the range of 550° to 600°, about 24% free metal (80% of the original Al) can be recovered from the starting 30% by volume. This is believed to be due to oxidation of the aluminum powder during mixing and reaction during heating. Above 600°, $AlB_2$ forms and aluminum is rapidly depleted. Between 600° and 700°, $AlB_2$ and $B_4C$ are the predominant phases. Above 700° $AlB_2$ and $Al_4BC$ are present and as temperature increases, the relative amount of $Al_4BC$ increases. Above 800°, small amounts of $Al_4C_3$, $AlB_{12}$ and $AlB_{24}C_4$ begin to form. At above 1000°, $AlB_2$ decomposes and generates free aluminum. Heat treatment above 1000° produces mainly $AlB_{24}C_4$ and $Al_4C_3$.

The major phases influencing the mechanical properties of $B_4C/Al$ based materials are $Al_4BC$, $AlB_2$, $AlB_{24}C_4$ and $Al_4C_3$. Because the formation of $AlB_{24}C_4$ is associated with the existence of undesirable $Al_4C_3$, densification and heat treatment should be limited to temperatures of about or below 800° C. or where $AlB_2$ and $Al_4BC$ are the only predominant new phases. Similar results are expected with other volumetric ratios of boron carbide and aluminum or aluminum alloys.

EXAMPLE 3

Boron carbide powder (ESK-15009 commercially available from Elektroschmelzwerk Kempten GmbH) and the same aluminum powder as in Example 1 are dry mixed in a 70:30 volumetric ratio. The mixed powders are heated from room temperature to 650° over a period of one hour. X-ray diffraction analysis, as in Example 19 reveals the phase compositions shown in Table I.

TABLE I

| Temperature °C. | Phases |
|---|---|
| 400 | $B_4C$, Al |
| 450 | $B_4C$, Al, $Al_4BC$ |
| 500 | $B_4C$, Al, $Al_4BC$ |
| 550 | $B_4C$, Al, $Al_4BC$ |
| 600 | $B_4C$, Al, $Al_4BC$, very small amounts of $AlB_2$ |
| 650 | $B_4C$, Al, $Al_4BC$, $AlB_2$ |

This example shows that if processing and heat treating are conducted below 600° and at 450° or above, a three phase composite can be produced. Extensive formation of $AlB_2$ is believed to begin at a temperature of 620°. Similar results are expected with other volumetric ratios of boron carbide and aluminum or aluminum alloys.

EXAMPLE 4

Boron carbide powder (ESK-600 grit) and the same aluminum powder as in Example 1 are dry mixed in a 50:50 volumetric ratio. The mixed powders are pressed into one inch (2.5 cm) diameter pellets and isostatically pressed as in Example 1. The pellets are then placed into a sealed aluminum can, as in Example 1. and heated to 560°, held at that temperature for 15 minutes and then isostatically pressed at 827 MPa, as in Example 1, for 15 seconds. The densified pellets have a density of 98.4% of theoretical density.

The densified pellets are subjected to a post-densification heat treatment as in Example 1 save for using a temperature of 500° and a time of 20 hours. X-ray diffraction analysis of the heat treated pellets reveals only three phases: free aluminum; $B_4C$; and $Al_4BC$. Similar results are expected with other volumetric ratios of boron carbide and aluminum or aluminum alloys. Similar results are also expected with other densification and heat treatment temperatures within the range of 450° to 600°.

What is claimed is:

1. A method for preparing a densified boron carbide-aluminum, ceramic-metal composite comprising: a) consolidating a powdered admixture of boron carbide and a metal selected from the group consisting of aluminum and aluminum alloys at a pressure of from about 34 to about 827 MPa and a temperature of from about 550° C. to less than 800° C. to produce a densified composite having a density of greater than about 98 percent of theoretical density based upon the powdered admixture; and b) subjecting the densified composite to a heat treatment at a temperature of from about 450° C. to less than 800° C. for a time of from about 1 to about 50 hours to produce a densified boron carbide-aluminum, ceramic-metal composite that is substantially free of $AlB_{12}$, $AlB_{12}C_2$ and $Al_4C_3$.

2. The method of claim 1 wherein the pressure in (a) is from about 600 MPa to about 827 MPa.

3. The method of claim 1 wherein the temperature in (b) is from about 450° C. to 600° C.

4. The method of claim 1 wherein the heat treatment temperature is from about 600° C. to 700° C.

5. The method of claim 1 wherein the time at temperature in (b) is from about 1 to about 30 hours.

6. The method of claim 1 wherein the powdered admixture has a metal content of from about 30 to about 80 volume percent and, conversely, a boron carbide content of from about 70 to about 20 volume percent, both percentages totaling 100 percent.

* * * * *